United States Patent [19]

Binet et al.

[11] 4,164,255

[45] Aug. 14, 1979

[54] HEAT EXCHANGER

[75] Inventors: Raymond Binet, Hellemmes; Alain Chielens, Marcq en Baroeul; Maurice Lebegue, Hellemmes, all of France

[73] Assignee: Fives-Cail Babcock, Paris, France

[21] Appl. No.: 851,219

[22] Filed: Nov. 14, 1977

[51] Int. Cl.[2] ..... F28F 9/04

[52] U.S. Cl. ..... 165/82; 16/2; 29/157.4; 165/76; 165/173; 285/158; 285/302

[58] Field of Search ..... 165/82, 172, 173, 175, 165/178, 76; 285/158, 187, 302; 16/2; 29/157.4

[56] References Cited

U.S. PATENT DOCUMENTS

| | | | |
|---|---|---|---|
| 2,447,259 | 8/1948 | Lucke | 285/158 |
| 2,816,739 | 12/1957 | Stoehr | 165/83 |
| 3,305,012 | 2/1967 | Allen | 165/178 |
| 3,338,600 | 8/1967 | Wahl | 285/158 |
| 3,572,770 | 3/1971 | Kagi | 285/158 |
| 3,583,478 | 6/1971 | Fieni | 285/158 |

FOREIGN PATENT DOCUMENTS

| | | | |
|---|---|---|---|
| 2300593 | 9/1976 | France | 285/158 |
| 6608016 | 12/1967 | Netherlands | 285/158 |
| 884924 | 12/1961 | United Kingdom | 165/82 |

*Primary Examiner*—Sheldon Jay Richter
*Attorney, Agent, or Firm*—Kurt Kelman

[57] ABSTRACT

A heat exchanger comprises an array of tubes, a perforated end plate defining a plurality of holes, a support sleeve in each hole for holding an end of a respective tube in a respective hole, each support sleeve fitting the respective hole, the exterior and interior surface of the support sleeve each defining a groove, a toroidal gasket in each groove, and a clamping portion on each support sleeve. The clamping portion is affixed to the outer face of the perforated end plate and has an end projecting beyond the end of the respective tube held in the support sleeve, and has an inwardly extending abutment at the projecting end for limiting any movement of the tube beyond the abutment.

10 Claims, 9 Drawing Figures

HEAT EXCHANGER

The present invention relates to improvements in a heat exchanger which comprises an array of tubes having an outer diameter, a perforated end plate having an outer face and defining a plurality of holes each having a diameter exceeding the outer diameter of the tubes, and a support sleeve in each of the holes for holding an end of a respective one of the tubes in a respective one of the holes while permitting the free axial expansion of the tubes with respect to the end plate. The exterior surface of each support sleeve fits the respective hole and an interior surface of each support sleeve is in contact with the respective tube. The exterior and interior surfaces each define a groove and a toroidal gasket in each groove forms a fluid-tight joint between the respective hole and the support sleeve as well as the support sleeve and the respective tube.

A heat exchanger of this type is known from French Pat. publication No. 2,300,593, published Oct. 9, 1976. In this heat exchanger, the tubes and their support sleeves are maintained in position by means of cotter pins passing through the tubes. This requires the tubes to be pierced by holes accommodating the pins and, to avoid deterioration of the joints when the support sleeves are placed over the tubes, the holes must be freed of burrs or even countersunk. For heat exchangers which comprise an array of several hundred tubes, this is a time-consuming and expensive operation.

It is the primary object of this invention to overcome this manufacturing disadvantage and to facilitate the assembly of the tubes.

This and other objects are accomplished in accordance with the invention with a clamping portion on each support sleeve, the clamping portion being affixed to the outer face of the perforated end plate and having an end projecting beyond the end of the respective tube held in the support sleeve, and an inwardly extending abutment at the projecting end of the clamping portion for limiting any axial movement of the tube beyond the abutment.

The above and other objects, advantages and features of the present invention will become more apparent from the following detailed description of certain now preferred embodiments thereof, taken in conjunction with the accompanying drawing wherein FIG. 1 is a vertical longitudinal section of a heat exchanger comprising an array of tubes;

Figure 1:
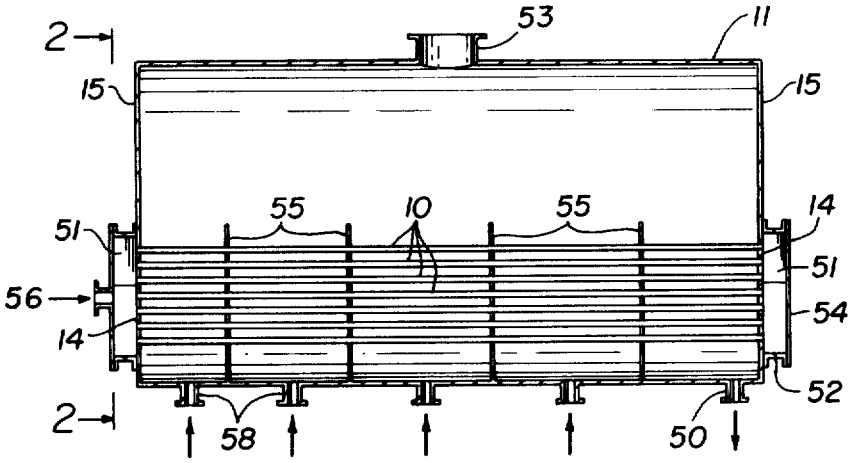
Figure 2:
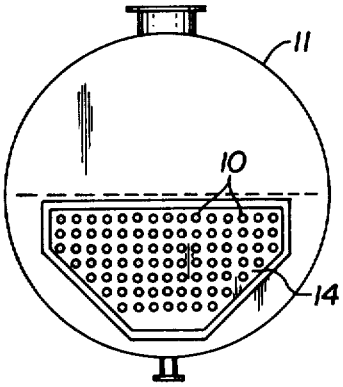
FIG. 2, is a transverse section along line 2—2 of FIG. 1.

Referring now to the drawing and first to FIGS. 1 and 2, the illustrated heat exchanger is used in the production of massecuite from a sugar juice mother liquor by evaporation. It is a generally conventional apparatus comprised essentially of cylindrical tank 11 which is positioned horizontally and closed by vertical end walls 15. A heat exchanger comprised of an array of tubes 10 arranged in parallel horizontal rows is mounted in the lower half of the tank. The ends of the tubes are held in perforated end plates 14 which are mounted in corresponding cut-outs in end walls 15 and are affixed thereto in any suitable manner, for instance by welding. Headers 51 comprised of lateral wall 52 and cover 54 are mounted on the perforated end plates, again by welding, if desired, and the ends of the tubes open into the headers. One of the headers has inlet 56 for a heat exchange medium, such as vapor, to deliver the heat exchange medium into tubes 10 and the other header has discharge means for the condensate and any uncondensed gases.

One or more inlets 58 for sugar juice are provided in the bottom of tank 11 to supply the mother liquor to the tank into heat exchange contact with tubes 10 whereby the liquor is evaporated as it flows along the heat exchanger from compartment to compartment defined between vertical partition walls 55 which have ports through which the fluid mass passes. The vapors produced by the evaporating mother liquor escape through flue 53 at the top of tank 11, the vapor circulating through tubes 10 heating the mother liquor which continuously flows from one end of the tank to the other and, as a result of the evaporation, forming and enlarging sugar crystals in the liquor. The massecuit is removed from the tank at outlet 50. All of this is conventional and forms no part of this invention which is concerned with the fluid-tight mounting of the heat exchanger tubes in perforated end plates.

Figure 3:
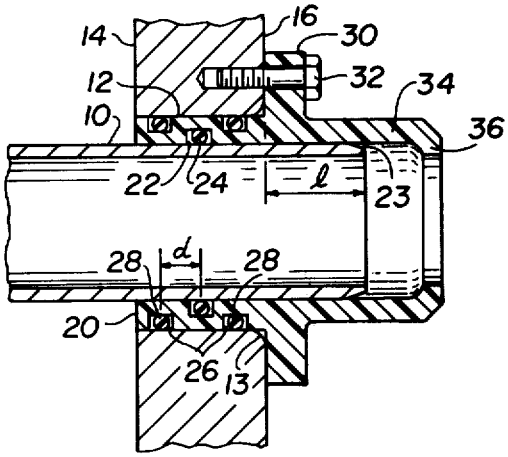
FIG. 3 is an enlarged sectional view of an end of one of the heat exchanger tubes mounted fluid-tightly in a perforated end plate in accordance with this invention.

As is shown in FIG. 3, end wall 14 has an outer face 16 and defines a plurality of holes 12 each having a diameter exceeding the outer diameter of tubes 10. Support sleeve 20 is mounted in each hole 12 for holding an end of a respective tube in a respective hole, an exterior surface of the support sleeve fitting the hole and an interior surface of the support sleeve being in contact with the tube. The exterior and interior surfaces of support sleeve 20 each define at least one groove, one interior groove 22 intermediate two exterior grooves 26 being provided in the illustrated embodiment. Toroidal gasket 24 is mounted in the interior groove and toroidal gaskets 28 are mounted in the exterior grooves whereby a fluid-tight joint is formed between hole 12 and support sleeve 20, on the one hand, and support sleeve 20 and tube 10, on the other hand. When the heat exchanger tube ends are mounted in this manner, none of the fluids circulating along the heat exchanger tubes, such as the mother liquor and vapors thereof, can escape through holes 12 into the headers.

Figure 4:
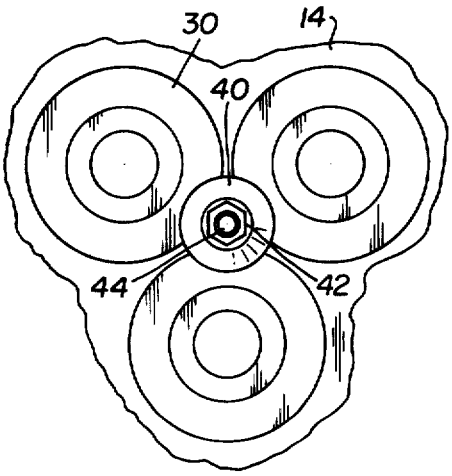
FIG. 4 is a similar view showing another embodiment of the tube mounting.

As is shown in FIG. 4, two interior grooves 22', with toroidal gaskets 24', may be provided, the interior grooves being axially staggered in relation to the exterior grooves, one of the interior grooves being closer to the tube end than the exterior grooves.

According to the present invention, support sleeve 20 has a clamping portion affixed to outer surface 16 of perforated end plate 14 and having end 34 projecting beyond the end of tube 10 held in the support sleeve. Inwardly extending abutment 36 at the projecting end of the clamping portion limits any axial movement of the tube beyond the abutment while permitting the tube to expand axially due to the heat to which it is subjected.

In the illustrated embodiment, the clamping portion includes flange 30 abutting outer surface 16 of the end plate. In the embodiment of FIG. 3, the clamping portion flange 30 is screwed to the end plate by bolts 32. As shown, the outer face of the end plate is chamfered at 13 around each hole 12 to facilitate the insertion of support sleeve 20 in the hole and the end of tube 10 is chamfered at 23 to facilitate the insertion of the tube in the support sleeve in a generally conventional manner. The tube projects beyond outer face 16 of the perforated end plate by a length l exceeding the axial distance d between interior groove 22 and inner exterior groove 26 in such a manner that joint 22, 24 will be in place before the inner joint 26, 28 will enter hole 10 when the tubes are mounted in their perforated end plates. This will facilitate the assembly operation.

The material for the support sleeves will be so selected as to eliminate any risk of electrochemical corrosion. Preferred materials for support sleeves 20 are synthetic resins, such as "Noryl" which is an oxide of a polyphenylene manufactured by General Electric Plastics, of The Netherlands.

Figure 5:
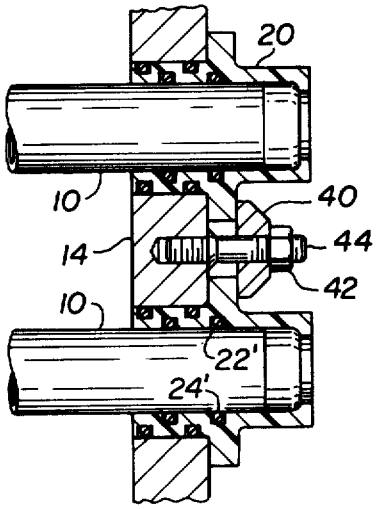
FIG. 5 is a planar end view of the assembly of FIG. 4.

FIGS. 4 and 5 illustrate an embodiment of this invention wherein a retaining element is provided for engaging a plurality of flanges 30 and which is affixed to outer face 16 of perforated end plate 14 for affixing a plurality of support sleeves 20 thereto. This reduces the number of points for affixing the clamping portions of the support sleeve to the end plate.

In the embodiment of FIGS. 4 and 5, the retaining element is disc 40 pressed against flanges 30 of three support sleeves clustered about the retaining disc by nut 42 threadedly mounted on pin 44 which is affixed to perforated end wall 14. Obviously, the pin and nut could be replaced by screws, bolts or like fastening elements.

Figure 6:
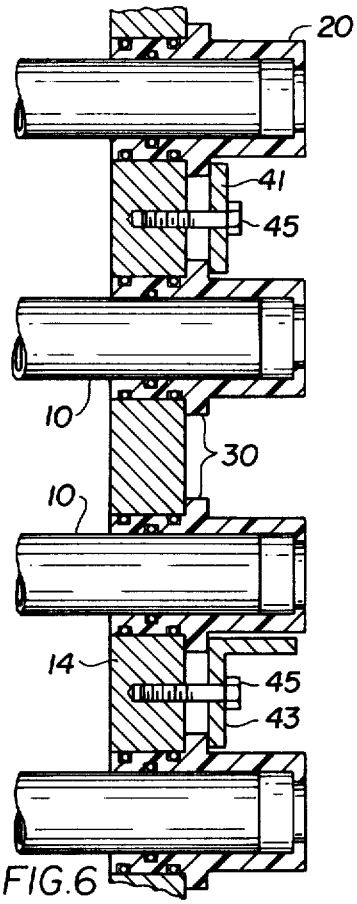
FIG. 6 is an enlarged sectional view showing yet another embodiment of the tube mounting.
Figure 7:
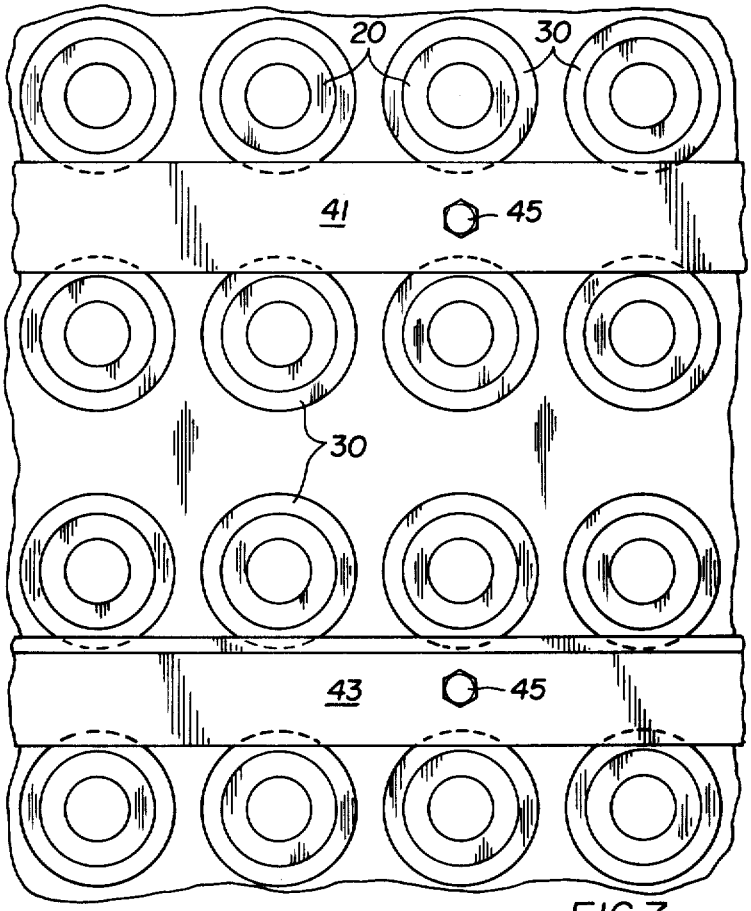
FIG. 7 is a planar end view of the assembly of FIG. 6.

In the embodiment of FIGS. 6 and 7, the retaining element is a metal, i.e. iron, plate 41 or angle iron 43 extending parallel to the rows of tubes 10 and between two adjacent ones of the rows to engage flanges 30 of the support sleeve clamping portions of the adjacent rows. The iron plates or angles irons are affixed to the perforated end plate by screw bolts 45 or like fastening elements. In this manner, a single retaining element affixes two adjacent rows of the support sleeves for the heat exchanger tubes to the end wall.

Figure 8:
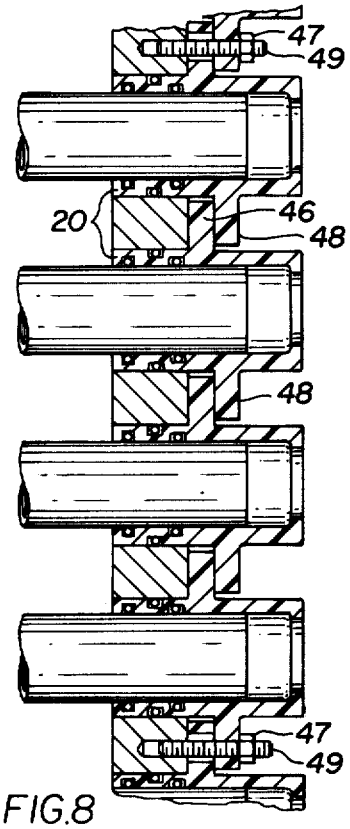
FIG. 8 is an enlarged sectional view showing a fourth embodiment of the tube mounting.
Figure 9:
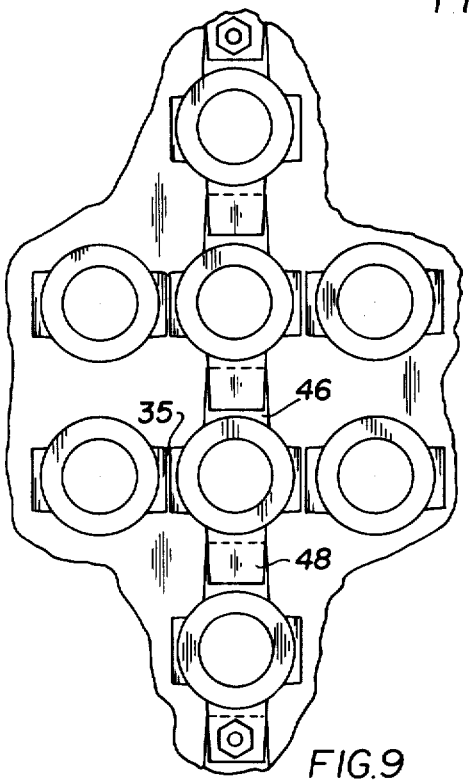
FIG. 9 is a planar end view of the assembly of FIG. 8.

In the embodiment of FIGS. 8 and 9, the clamping portion of each support sleeve includes two diametrically opposed lugs 46, 48 which are axially staggered from each other. In this manner and as clearly illustrated in FIG. 8, when a first row of tubes is affixed and an adjacent row of tubes is put into place, the lugs 46 of their support sleeves will be in flush engagement with outer surface 46 of the perforated end wall while lugs 48 will overly and be in flush engagement with lugs 46. This permits the support sleeves of an entire tow of tubes to be held in place by a single fastening element, such as pin 49 and nut 47, at each end of the row although it may be desired to use several fastening elements for each row to make the fastening more secure.

To prevent disengagement of the superposed lugs 46 and 48, it is desirable to prevent the support sleeves from rotating in their holes. FIG. 9 illustrates such means consisting of diametrically opposed stops 35 displaced 90° from lugs 46, 48 and cooperating with identical stops on the support sleeves of the adjacent rows of tubes.

What is claimed is:

1. In a heat exchanger which comprises an array of tubes having an outer diameter, a perforated end plate having an outer face and defining a plurality of holes each having a diameter exceeding the outer diameter of the tubes, a support sleeve in each of the holes for holding an end of a respective one of the tubes in a respective one of the holes, an exterior surface of each support sleeve fitting the respective hole and an interior surface of each support sleeve being in contact with the respective tube, the exterior and interior surfaces extending along the hole and each defining a groove, and a toroidal gasket in each of the grooves whereby a fluid-tight joint is formed between the respective hole and the support sleeve as well as the support sleeve and the respective tube: a clamping portion on each support sleeve, the clamping portion being affixed to the outer face of the perforated end plate and having an end projecting beyond the outer end plate face and the end of the respective tube held in the support sleeve, and an inwardly extending abutment at the projecting end of the clamping portion for limiting any movement of the tube beyond the abutment.

2. In the heat exchanger of claim 1, the clamping portion of the support sleeves including a flange, and further comprising a retaining element engaging a plurality of the flanges and affixed to the outer face of the perforated end plate for affixing a plurality of the support sleeves thereto.

3. In the heat exchanger of claim 2, the retaining element being a disc.

4. In the heat exchanger of claim 2, the retaining element being a metal plate, the tubes being arrayed in rows and the retaining metal plate extending parallel to the rows of tubes.

5. In the heat exchanger of claim 4, the retaining metal plate extending between two adjacent ones of the rows of tubes and engaging the flanges of the support sleeve clamping portions of the adjacent rows.

6. In the heat exchanger of claim 1, the clamping portion of the support sleeves including diametrically opposed and axially staggered lugs, the tubes being arrayed in rows and one of the lugs of each of the support sleeves in each of the rows overlying the axially staggered lug of an adjacent one of the support sleeves in the row, and further comprising means for preventing the rotation of the support sleeves in the holes.

7. In the heat exchanger of claim 6, the rotation preventing means comprising diametrically opposted stops on the support sleeves displaced 90° from the lugs and cooperating with identical stops on the support sleeves of an adjacent row of tubes.

8. In the heat exchanger of claim 1, the tube end projecting beyond the outer face of the perforated end plate by a length exceeding the axial distance between the groove in the interior surface and the groove in the exterior surface nearest the end of the support sleeve opposite the projecting end thereof.

9. In the heat exchanger of claim 8, the exterior surface of the support sleeve defining two of said grooves adjacent respective ends of the holes in the perforated end plate.

10. In the heat exchanger of claim 1, the support sleeves being of synthetic resin.

* * * * *